US005145481A

United States Patent [19]

Friedebach

[11] Patent Number: 5,145,481

[45] Date of Patent: Sep. 8, 1992

[54] SKI EXERCISE MACHINE

[75] Inventor: Adolph H. Friedebach, Chanhassen, Minn.

[73] Assignee: Fitness Master, Inc., Waconia, Minn.

[21] Appl. No.: 550,861

[22] Filed: Jul. 10, 1990

[51] Int. Cl.[5] ..... A63B 22/00; A63B 69/18

[52] U.S. Cl. ..... 482/70; 482/118

[58] Field of Search ..... 272/70, 72, 97, 69; 482/70, 71, 62, 72, 73, 118, 119

[56] References Cited

U.S. PATENT DOCUMENTS

| | | | |
|---|---|---|---|
| 4,340,214 | 7/1982 | Schutzer | 272/97 |
| 4,618,139 | 10/1986 | Haaheim | 272/97 |
| 4,659,077 | 4/1987 | Stropkay | 272/97 |
| 4,804,178 | 2/1989 | Friedebach | 272/97 |
| 4,813,667 | 3/1989 | Watterson | 272/97 |
| 4,900,013 | 2/1990 | Rogers | 272/73 |

*Primary Examiner*—Stephen R. Crow
*Attorney, Agent, or Firm*—Dorsey & Whitney

[57] ABSTRACT

A ski exercise machine is provided. The machine includes side-by-side, wheeled foot skate assemblies positioned on three tracks, a center track and two outer tracks. Movable arm poles are operably connected to the center track and extend generally upwardly and outwardly from between the skate assemblies. The foot skates are attached to an adjustable resistance belt system and the arm poles are rotated about an adjustable resistance system. The ski exercise machine is ergonomically designed for aesthetic appearance as well as function and utility in exercising.

6 Claims, 14 Drawing Sheets

SKI EXERCISE MACHINE

BACKGROUND OF THE INVENTION

The present invention pertains to an exercise machine, more particularly, a ski exercise machine.

The major technical problem in the designs of ski exercise machines with ski poles derives from the considerable torque generated by the movement of the long lever arms of the ski poles, particularly when the point from which the poles extend vertically is spaced from the longitudinal axis of the machine.

Even a moderate arm resistance at the handgrip translates into significant torque at the bottom of the pole where the resistance has to be applied. This causes difficulty when it is desired that the arm poles simply fold down for storage, because pull pins, wing nuts or other sufficiently strong complicated connections usually must be disassembled before folding.

The existence of the large movement at the connecting points of the arm poles to the structure of the ski exercise device means the skier frame has to be able to withstand cylindrical torque as well as other torques in opposing directions.

A representative prior art cross-country ski exercise device is disclosed in U.S. Pat. No. 4,804,178, issued to Friedebach on Feb. 14, 1989. This patent is for a ski exercise device which is complex in assembly of the components. The center of gravity of the poles with respect to the foot skates is transferred down to the outer ends of the device.

The ski exercise machine of the present invention overcomes problems not addressed in prior art by providing a unique resistance belt system and a unique arm pole system. The poles originate close to the center line of the machine. The resistance belt system provides for greater leg resistance and is substantially concealed by the elevated center track without increasing manufacturing costs. The present invention provides smoother leg movement, more available arm resistance, and more available leg resistance. The arm poles are one piece, with provision for gripping by users of various heights, and provide a firm grip with no wiggling between separate parts as in the prior art arm poles. The exercise machine of the present invention is quieter and more durable than comparably priced prior art machines.

SUMMARY OF THE INVENTION

The general purpose of the present invention is to provide an ergonomically designed ski exercise machine that includes an unique resistant belt system and an unique arm pole system.

According to one embodiment of the present invention, the ski exercise machine includes a center track and two outer tracks, wherein the center track is at a height above the two outer tracks. The resistance belt system and is operably connected to and connects two foot skate assemblies, each engaged between the center track and one of the two outer tracks. The arm pole resistance system connects to the front of the center track between the foot skates and closely adjacent to the longitudinal center of the machine and the center track. The machine optionally includes an electronics pole for supporting optional electronic monitoring equipment.

Significant aspects and features of the ski exercise machine of the present invention include that the machine is ergonomically designed in utility and function, as well as aesthetically pleasing. The ski exercise machine is sturdier, provides smooth leg movement, is quieter, and provides more available arm resistance and more available leg resistance than comparably priced prior art machines. The arm poles are one piece with provision for gripping at various heights resulting in a firm grip with no wiggling as could occur between separate parts of prior art arm poles. The ski exercise machine can be manufactured at a cost effective price.

Another significant aspect and feature of the present invention is that the ski exercise machine has arm poles that are swingable enough to assume a position alongside the outer tracks, providing a low profile and making the machine easily storable in either a horizontal plane, such as on the floor, or in a vertical plane, such as against the wall.

Further significant aspects and features of the present invention are that the ski exercise machine makes use of all the major muscle groups in a rhythmic, nonimpact motion that is as natural as walking and is easy on a user's knees and back. The machine coordinates use of muscle groups in push-pull exercise; facilitates raising the heart rate; tones muscles throughout the body and burns calories fast so that one looks and feels younger and more energetic. Further advantages are that exercising on the machine of the present invention strengthens the heart and lungs; helps to reduce high blood pressure and cholesterol levels; provides weight-bearing exercise that strengthens bones; helps to prevent bone density loss associated with osteoporosis; improves mobility and flexibility; and, reduces stress and increases the sense of well being.

Still additional significant aspects and features of the present invention include: no special coordination or previous skiing experience is required; the foot skates, with safety toe holds, glide smoothly and quietly along anodized aluminum tracks, coordinated by a concealed resistance belt; independently adjustable resistance is provided for the upper and lower body; and the exercise position is upright and comfortable with no need to lean forward, because the foot skates are interconnected in such a way that the user's body center of gravity automatically remains centered between the user's feet in a fore and aft orientation.

Other advantages and features of the present invention are that the sturdy steel arm poles provide additional body support as well as upper body workout, yet fold down for easy carrying and storage. The contemporary styling harmonizes with any decor. Optional motivational electronics with easy-to-read display can be used.

It is a principal object of the present invention to provide a ski exercise machine.

Another object of the present invention is to provide a ski exercise machine compatible for use by most individuals.

Yet another object of the present invention is to provide a ski exercise machine which has a reliable and easily adjustable resistance belt mechanism, and a reliable and easily adjustable arm pole resistance system.

Other objects of the present invention include providing a ski exercise machine with a fully concealed operating mechanism, fewer moving parts, and no required lubrication. The machine of the present invention is lighter in weight without sacrificing strength and rigidity in use, is easier to move and to store away fully assembled, and provides for quieter operation, simplified parts replacement, and optional electronics.

DESCRIPTION OF THE PREFERRED EMBODIMENTS

Figure 1:
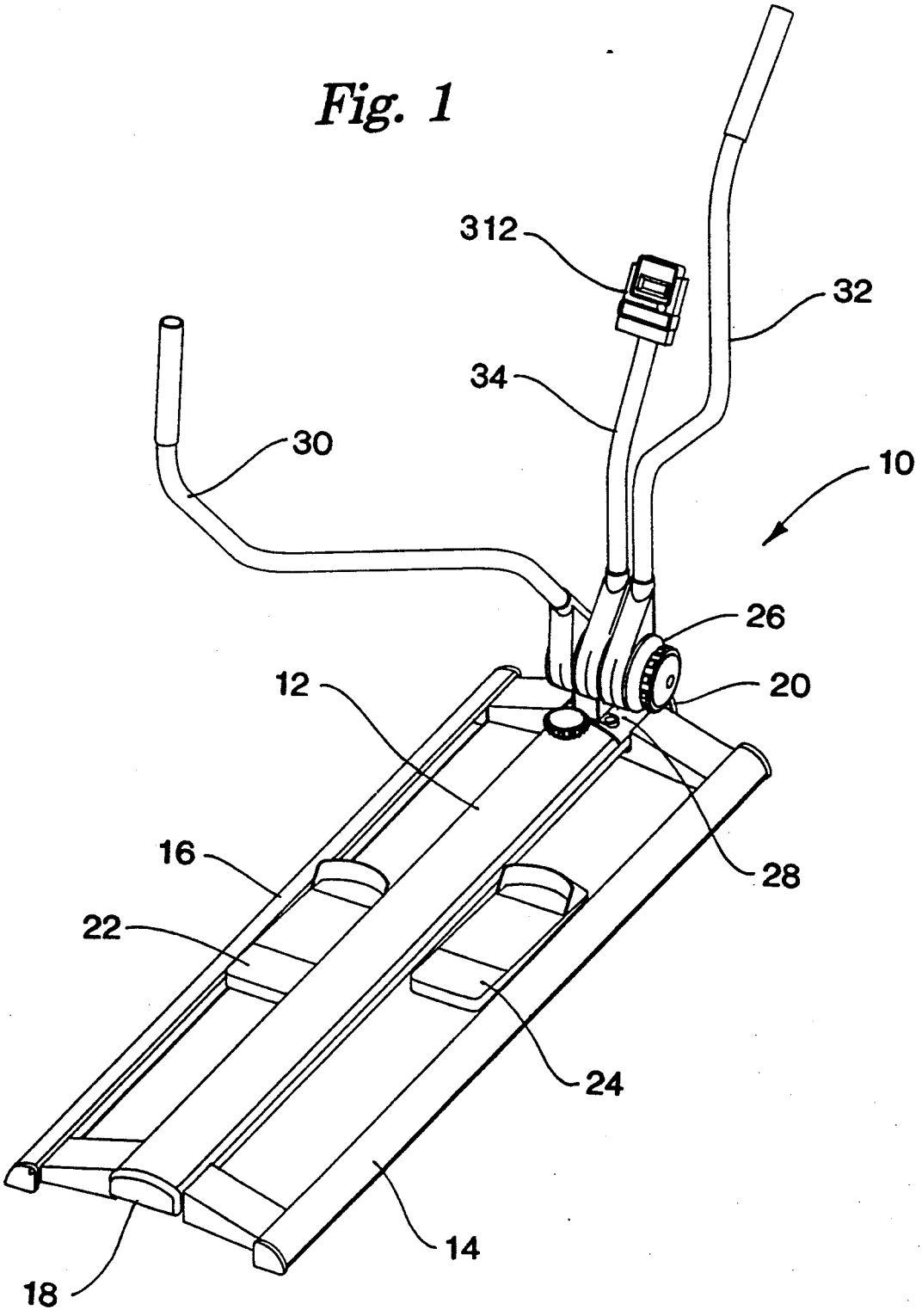
FIG. 1 is a perspective view of the ski exercise machine of the present invention in an operable mode.

FIG. 1 is a perspective view of the ski exercise machine 10 of the present invention ready for use. The machine 10 includes a center track 12, a right track 14 and a left track 16. The right track and left track, 14, 16, respectively, are symmetrical with respect to each other. The tracks are held together with respect to each other by a molded rear cross bar 18 and molded front cross bar 20, as later described in detail herein with reference to FIGS. 4–6. The rear cross bar 18 and front cross bar 20 are identical. Foot skate assemblies 22 and 24 are positioned between the center track 12 and right track 14 (skate assembly 24) and the center track 12 and left track 16 (skate assembly 22) as later described in detail. A leg resistance system connects to the foot skate assemblies 22, 24 as later described in detail. An attachment assembly 26, including a plate 28, supports a left arm pole 30, a right arm pole 32, an arm pole resistance system 33 and an electronics mounting pole 34 as later described in detail. An electronics module 312 mounts on pole 34.

Figure 2:
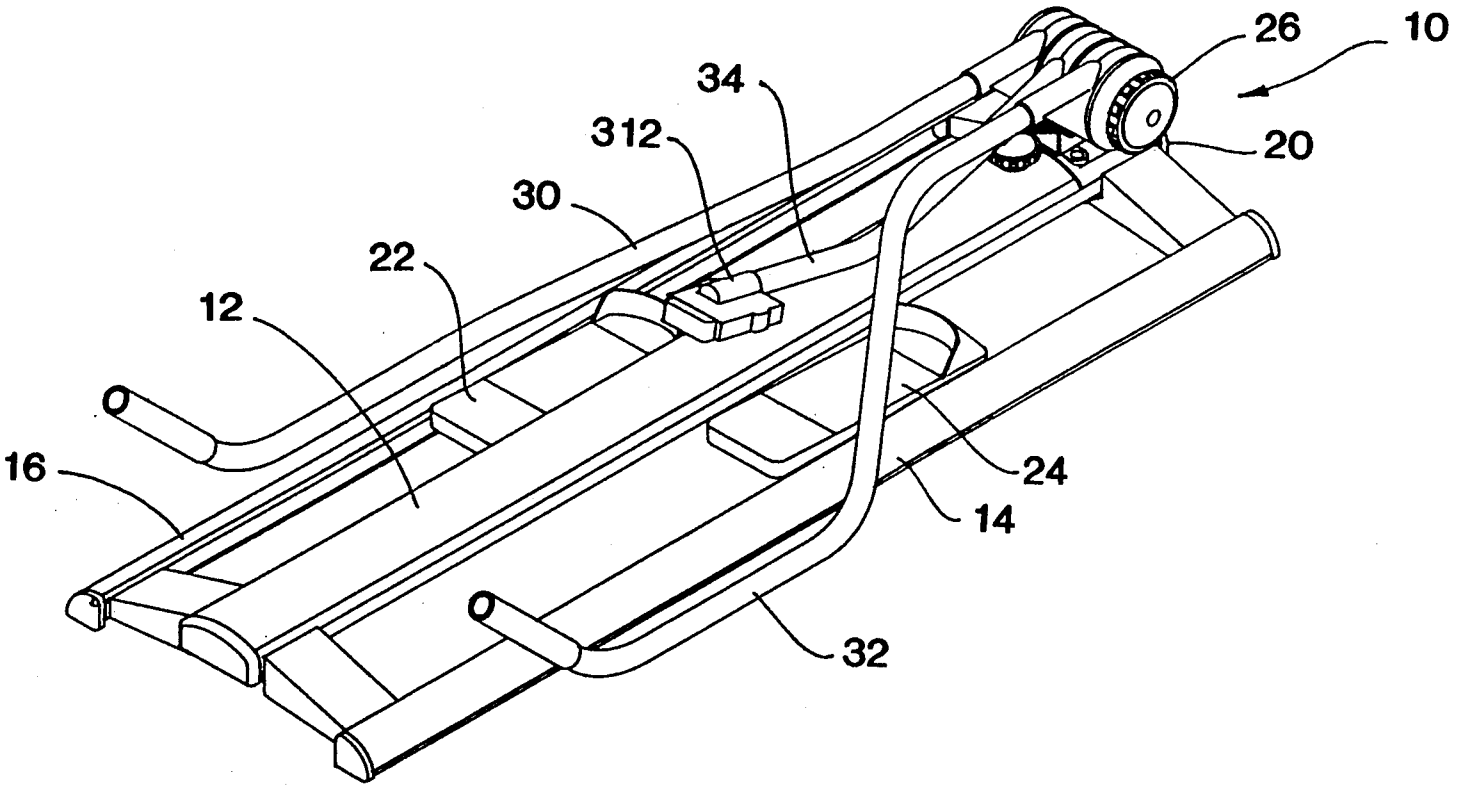
FIG. 2 is a perspective view of the ski exercise machine in a storage mode.

FIG. 2 is a perspective view of the ski exercise machine 10 in a nonuse or storage mode. The folded down position of the arm poles 30, 32 enables convenient, easy storage.

Figure 3:
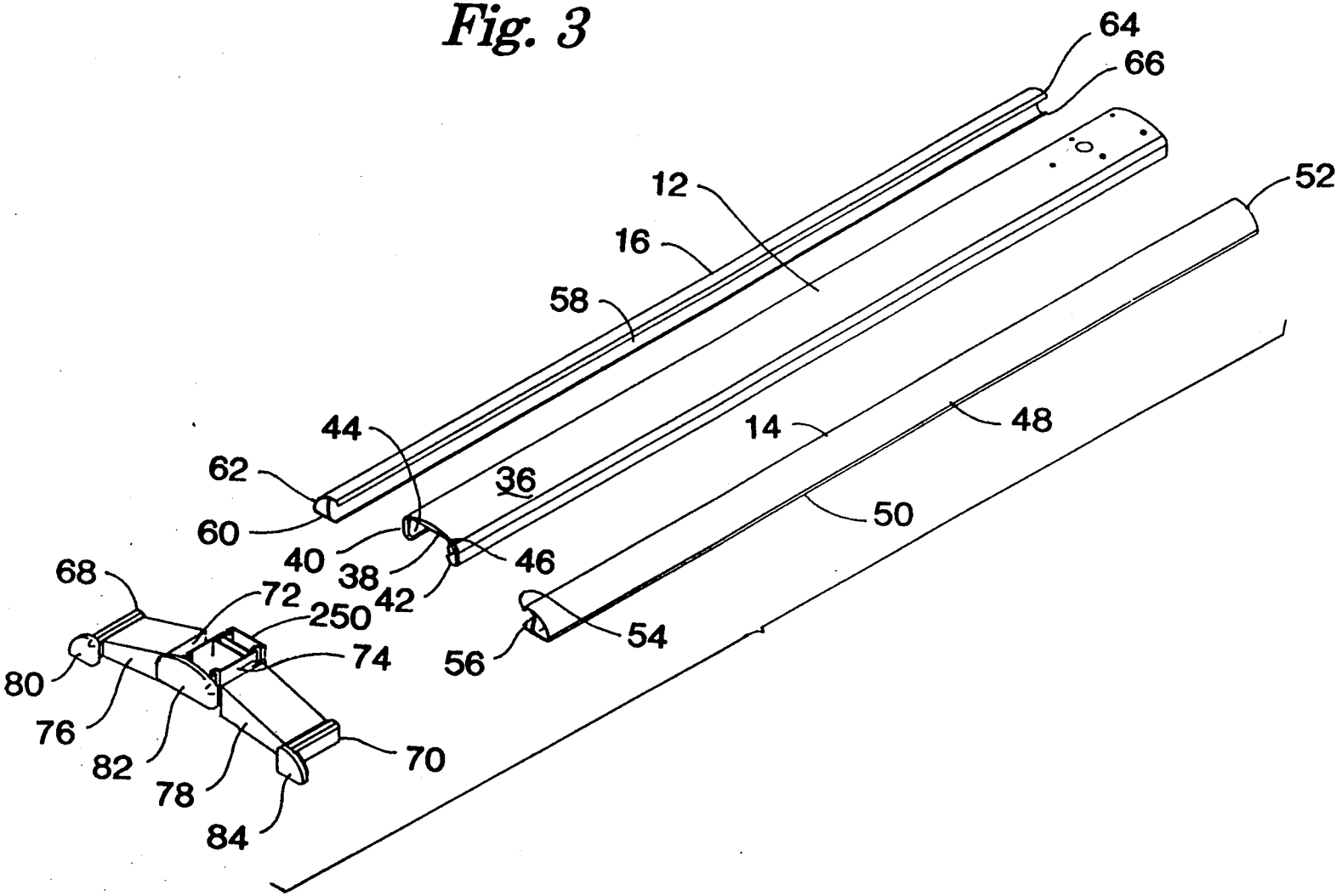
FIG. 3 is a perspective view of a cross bar separated from the tracks of the ski exercise machine.

FIG. 3 is a perspective view of one of the identical cross bars 18, 20 separated from the tracks 12, 14, 16. The center track 12 includes a rounded curved top 36, a connecting flat planar member 38 and two opposed downwardly extending members 40 and 42 with upwardly curved portions forming channels 44 and 46. The left track 16 and right track 14 are identical and are illustrated in FIG. 3. The right track 14 includes two sides 48 and 50 and a curved connecting member 52. Two opposed symmetrical channels 54 and 56 align with respect to each other. Likewise, the left track 16 includes two sides 58 and 60, a curved connecting member 62, and two opposed channels 64 and 66.

Each of the cross bars 18, 20 are identical and include outer members 68 and 70 to engage in the left and right tracks 16, 14, respectively, and channels 72 and 74 to engage with the downwardly extending members 40 and 42 of the center track, as well as the channels 44 and 46. Members 76 and 78 provide for spacing and connection of the cross bars 18, 20 and tracks 12, 14, 16. Decorative ends 80, 82 and 84 provide for capping each end of the center track 12, the right track 14 and the left track 16.

Figure 4:
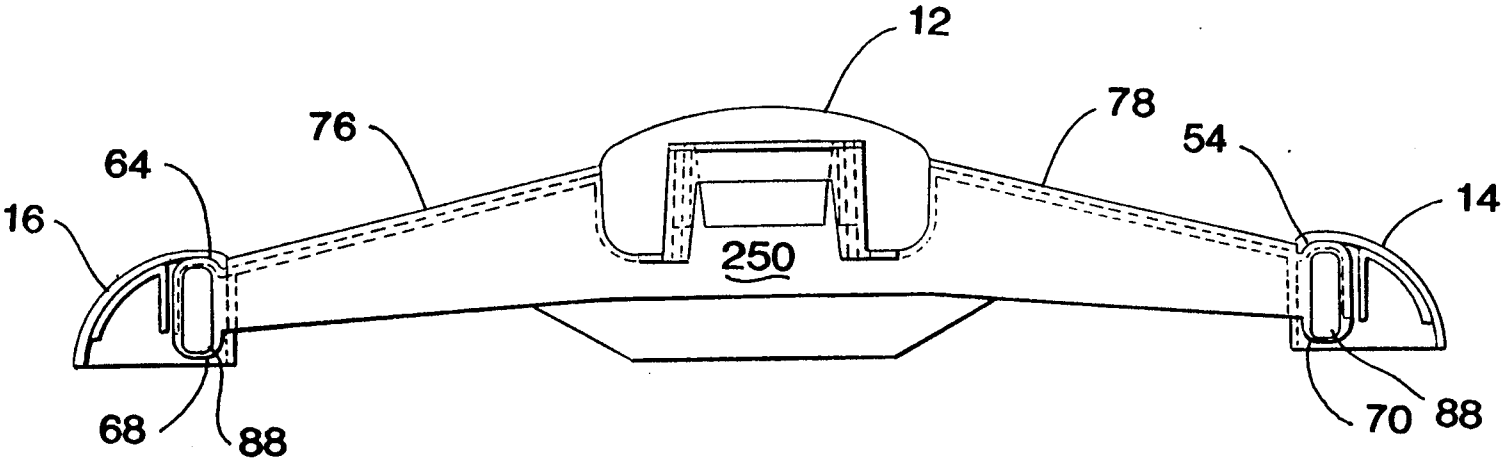
FIG. 4 is an end view of cross bar.
Figure 5:
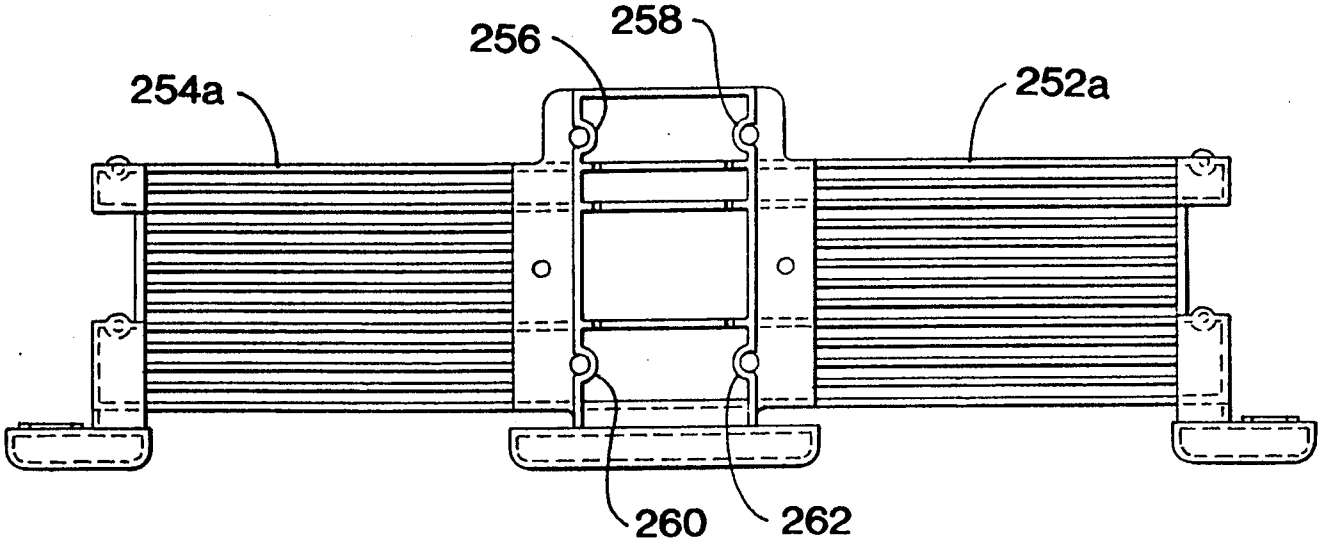
FIG. 5 is a top view of the cross bar.
Figure 6:
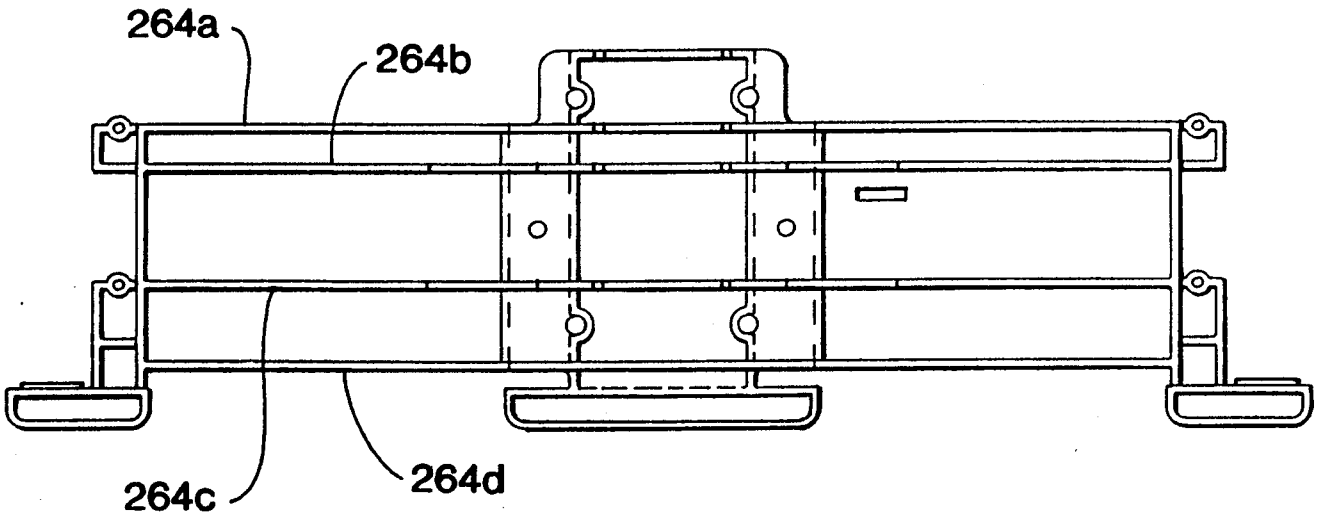
FIG. 6 is a bottom view of the cross bar.

FIG. 4 is an end view of one of the cross bars 18, 20 coupled to the tracks 12, 14, 16. All numerals correspond to those elements previously described. Connecting members 76 and 78 connect the outer members 68, 70 and member 250 together, as also illustrated in FIGS. 5 and 6. FIG. 5 is a top view of one of the cross bars 18, 20 showing optional decorative grooves 252*a* and 254*a* and screw holes 256–262, and FIG. 6 is a bottom view of one of the cross bars 18, 20 showing reinforcing ribs 264*a*.

Figure 7:
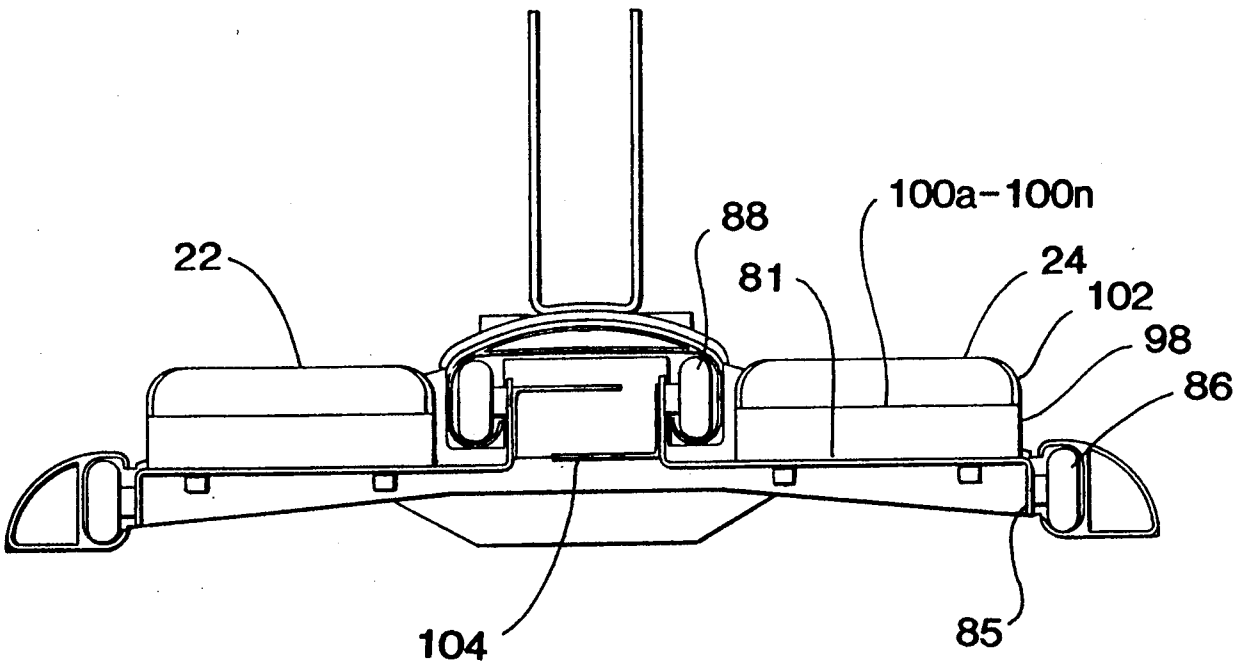
FIG. 7 is a cross-sectional view of the foot skate assemblies and tracks of the ski exercise machine of the present invention.
Figure 8:
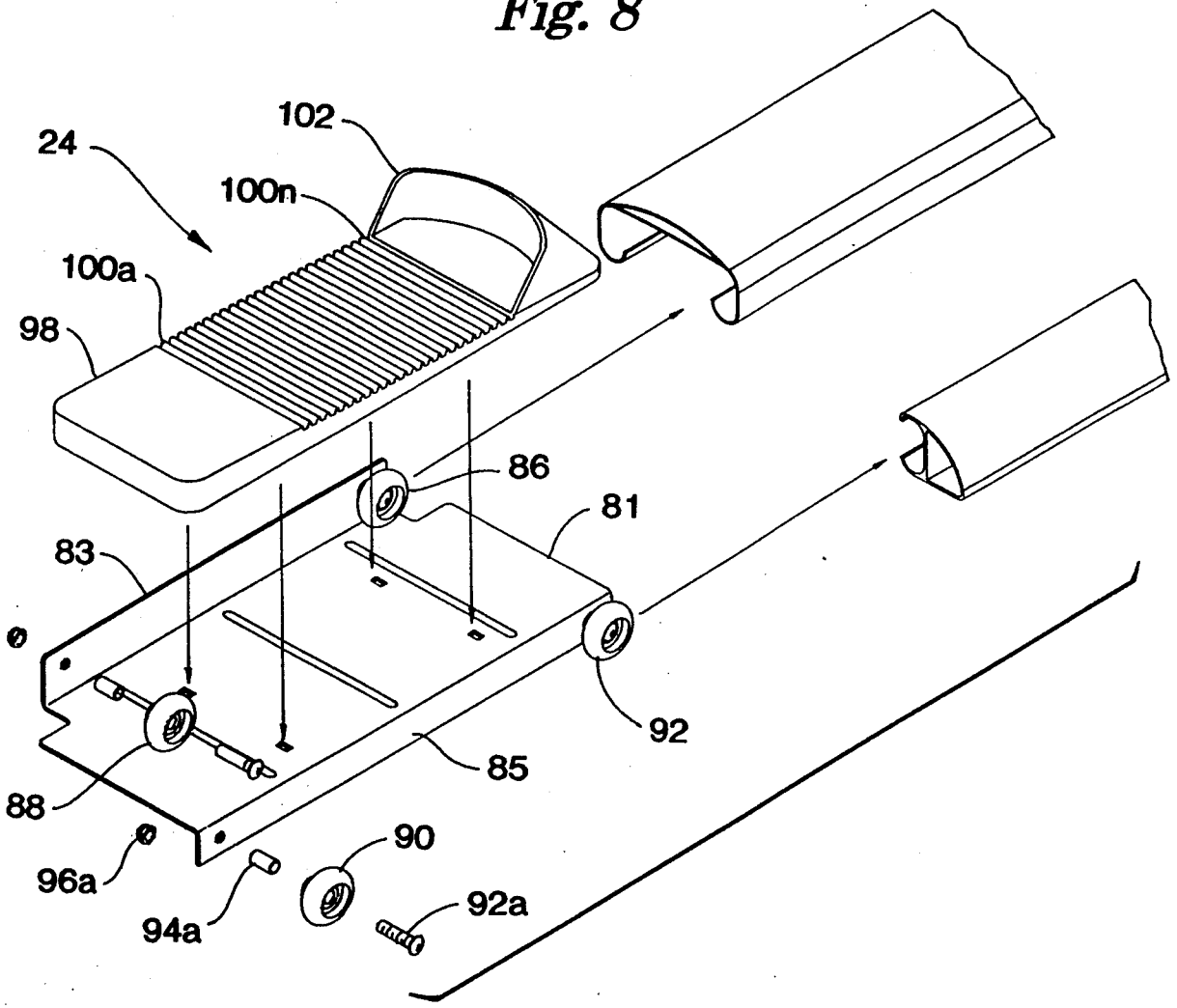
FIG. 8 is an exploded perspective view of the right foot skate assembly.
Figure 14:
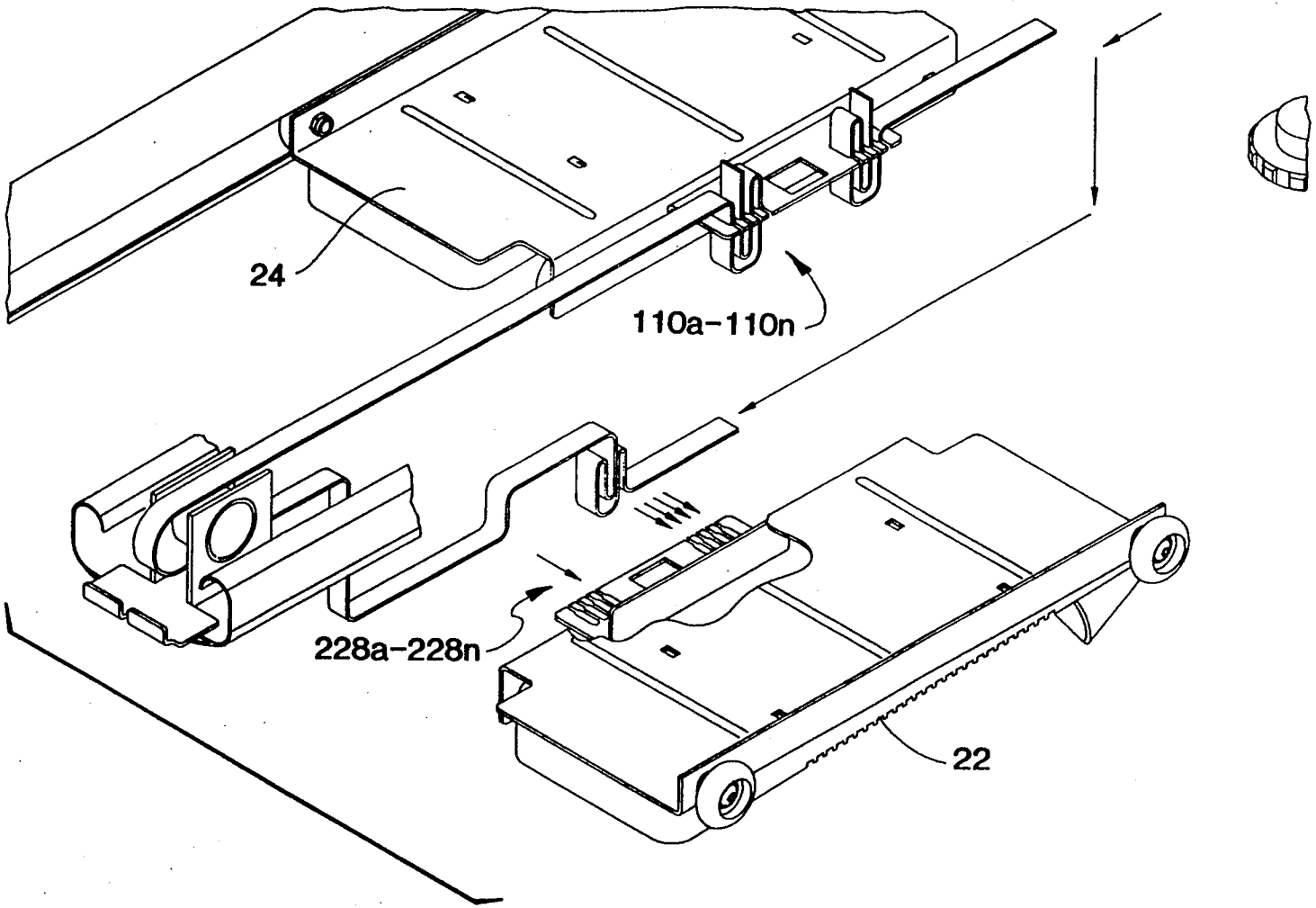
FIG. 14 is an enlarged perspective of the resistance belt system depicted in FIG. 13 and shows in greater detail the connection between the belt and the belt anchors of the skate assemblies.

FIG. 7 is a cross-sectional view depicting the tracks 12, 14, 16 and the foot skate assemblies 22, 24. The right foot skate assembly 24, shown in exploded perspective in FIG. 8, includes a plate 81 with two flanges 83 and 85. The right foot plate 81 includes four wheels 86, 88, 90 and 92 for engagement with the center track channel 46 and the right track channels 54, 56. Each of the wheels are rotatable on a bushing 94, being secured to the plate 81 by a bolt 92, and nut 96. A plastic foot plate 98 with grooves 100*a*–100*n* and a toe hold 102 fastens to the plate 81 with suitable mechanical tabs, screws or suitable adhesive. A belt anchor 104 is attached to the flange 83 of the plate 81 by suitable bolts or welding and includes a plurality of web slots 110*a*–110*n* as illustrated in FIG. 14 for securing a resistance belt to each skate assembly 22, 24, as later described in detail.

With reference to FIG. 7, the left skate assembly 22 is like the right skate assembly 24, including a plate 208 with flanges 210 and 212. The left foot plate 208 includes four wheels 214, 216, 218 and 220 for engagement with center track channel 46 and left track channels 64, 66, and a plastic foot plate 222 with a toe hold 224. A right angle belt anchor 226 bolts onto the side flange 212 and includes a plurality of web slots 228*a*–228*n*, not shown in FIG. 7, but substantially similar to the right side web slots 110*a*–110*n* depicted in FIGS. 13 and 14.

Figure 9:
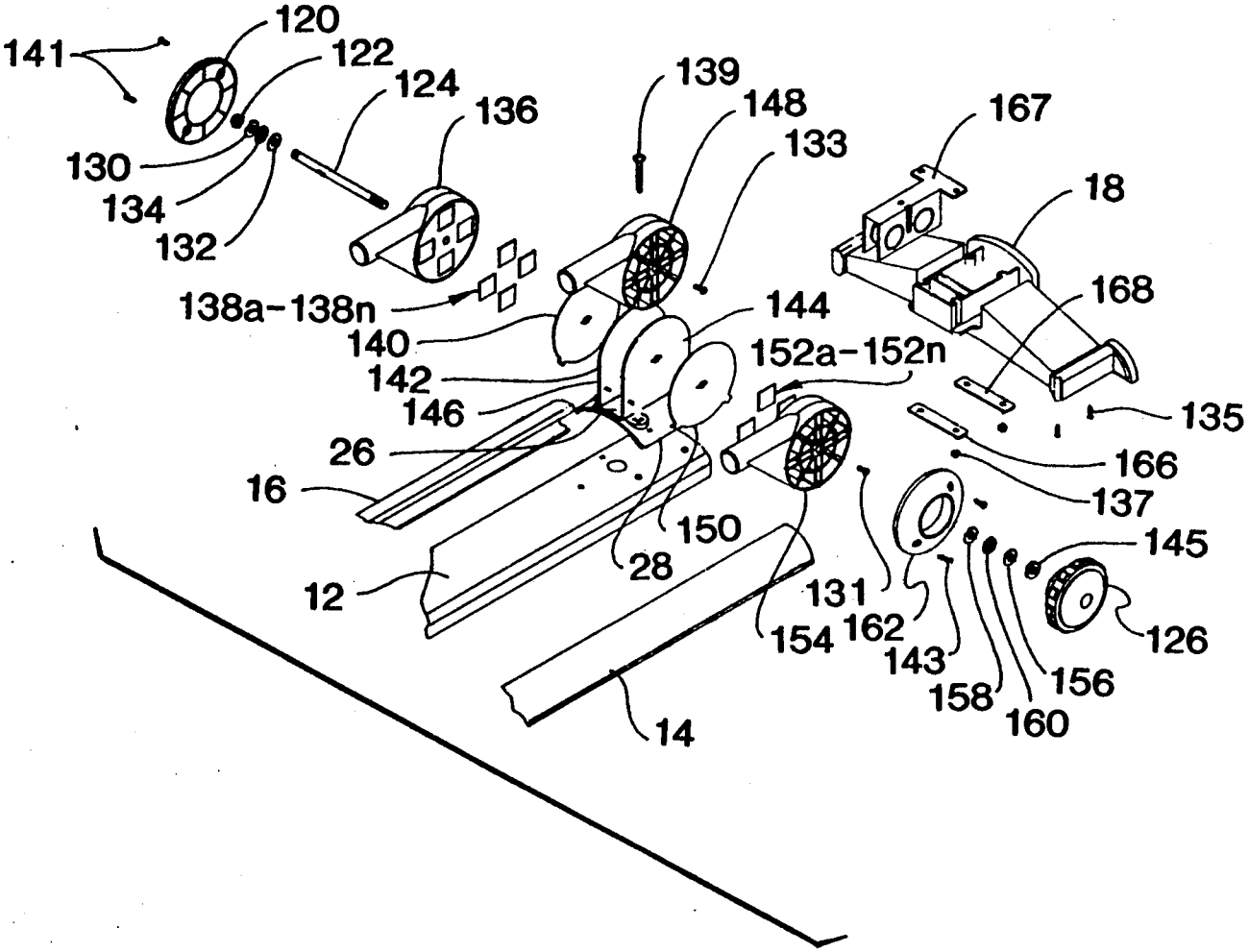
FIG. 9 is an exploded perspective view of the arm pole resistance system.

FIG. 9 is an exploded perspective view of the arm pole resistance system 33 including, from left to right, a cross bar 120, a nut 122, a bolt 124, thrust bearing races 130, 132 with a thrust bearing 134, a left arm pole housing 136, a plurality of friction pads 138*a*–138*n* for insertion in the housing 136, a wear plate 140, a left U-shaped channel side 142, and a right U-shaped channel side 144 of the attachment assembly 26, an electronics pole housing 148, a wear plate 150, friction pads 152*a*–152*n*, a right arm pole housing 154, thrust bearing races 156 and 158, thrust bearing 160, a cross bar 162, and a knob 126.

The right and left U-shaped channel sides, 142, 144, respectively, are joined to the center arm attachment plate 28 which fits over the curved front portion of the center track 12. The plate 28 is bolted, through the center track 12, to the front cross bar 18 with suitable fasteners, for example, left and right fastening screws 135. Reinforcing members 166 and 168 may be used. Other fastening means used in the arm pole resistance system 33 include: arm pole fastening screw 131, center pole fastening screw 133, arm pole resistance mounting nut 137, arm pole resistance mounting bolt 139 and left and right cross bar mounting screws 141, 143.

Figure 10:
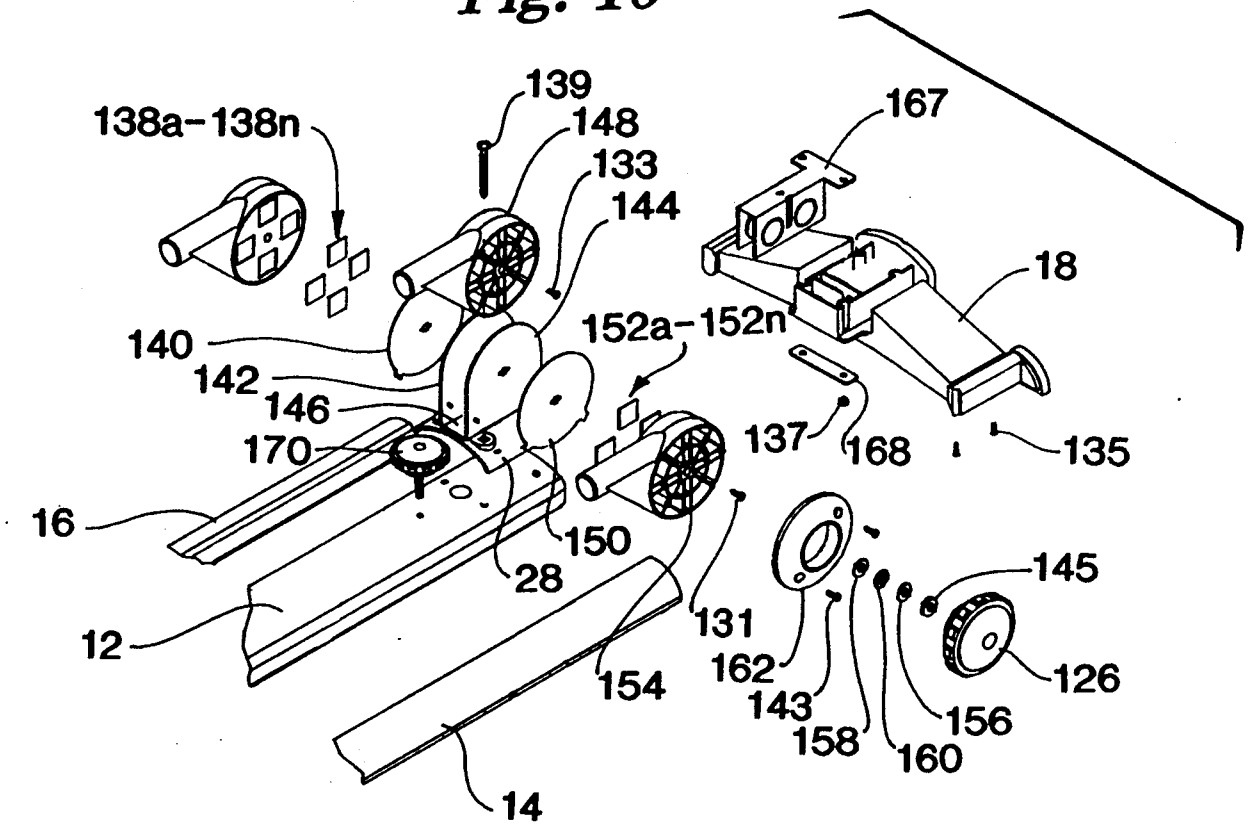
FIG. 10 is an exploded perspective view of the front end of the exercise machine of the present invention depicting the resistance belt system and the arm pole resistance system.

The resistance belt system for adjusting and controlling skate assembly resistance, and thereby the amount of work expended by the lower body of an exerciser, is depicted in FIG. 10–13. FIG. 10 is an exploded perspective view depicting the front portion of the ski exercise machine, including the portion of the resistance belt system above the center track 12 (knob 170) and part of the portion below the arm pole resistance system 33 (front hub assembly 167).

Figure 11:
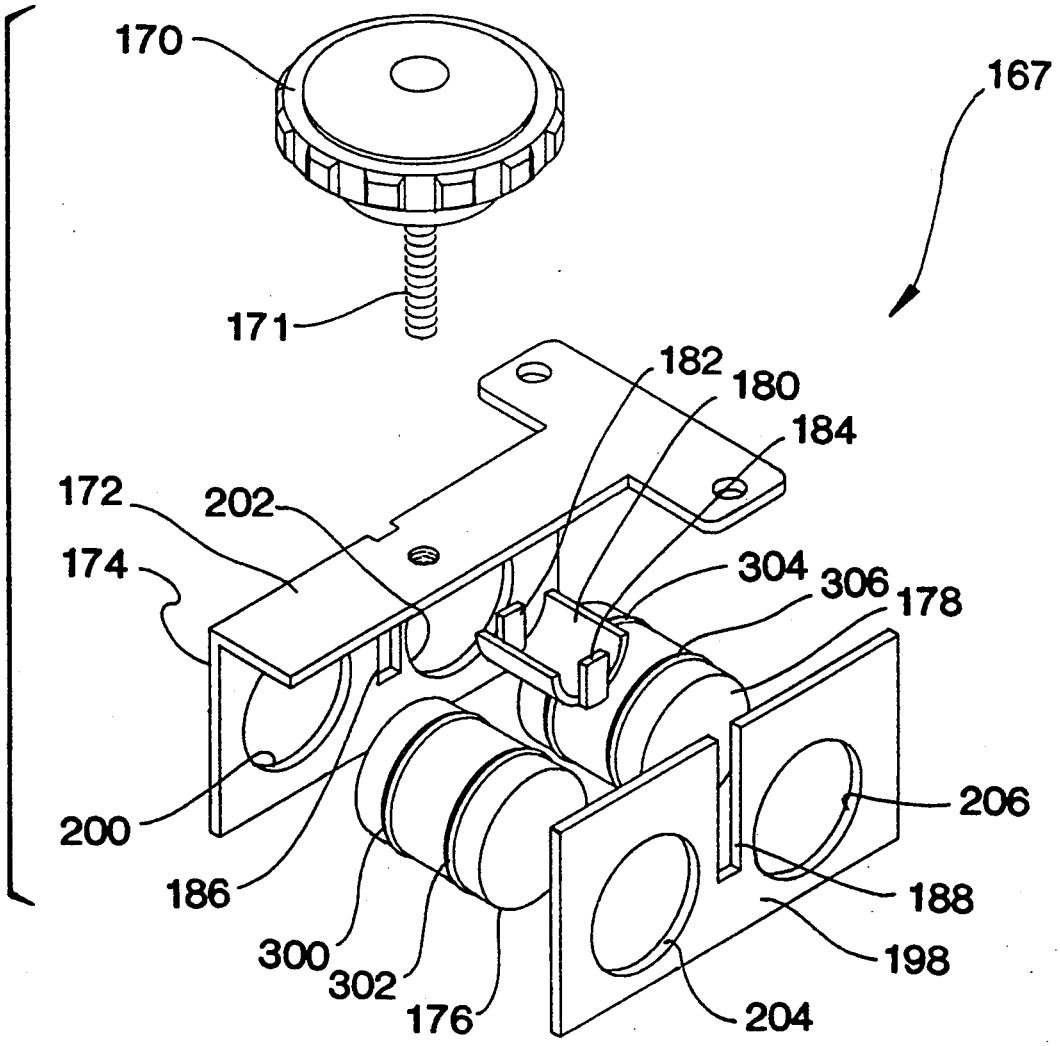
FIG. 11 is an exploded perspective view of the front portion of the resistance belt system.

FIG. 11 is an exploded perspective view of the front resistance assembly of the resistance belt system, including the front hub assembly 167 and knob 170. The front hub assembly includes a knob 170 on a threaded shaft 171, a configured top plate 172, a side plate 174 attached to the top plate 172, hubs 176, 178, and a tension hub 180, including tabs 182 and 184 for riding in slots 186, 188 in the first side plate 174 and a second side plate 198, respectively. The second plate 198 mates to the first plate 174. Both of the plates 174 and 198 include opposing front holes 202, 206 and rear holes 200, 204 for location of the hubs 178, 176, respectively. Each of the hubs 176, 178 includes two radius beads 300, 302 and 304, 306 which retain the hubs 176, 178 between the two plates 174 and 198.

Figure 12:
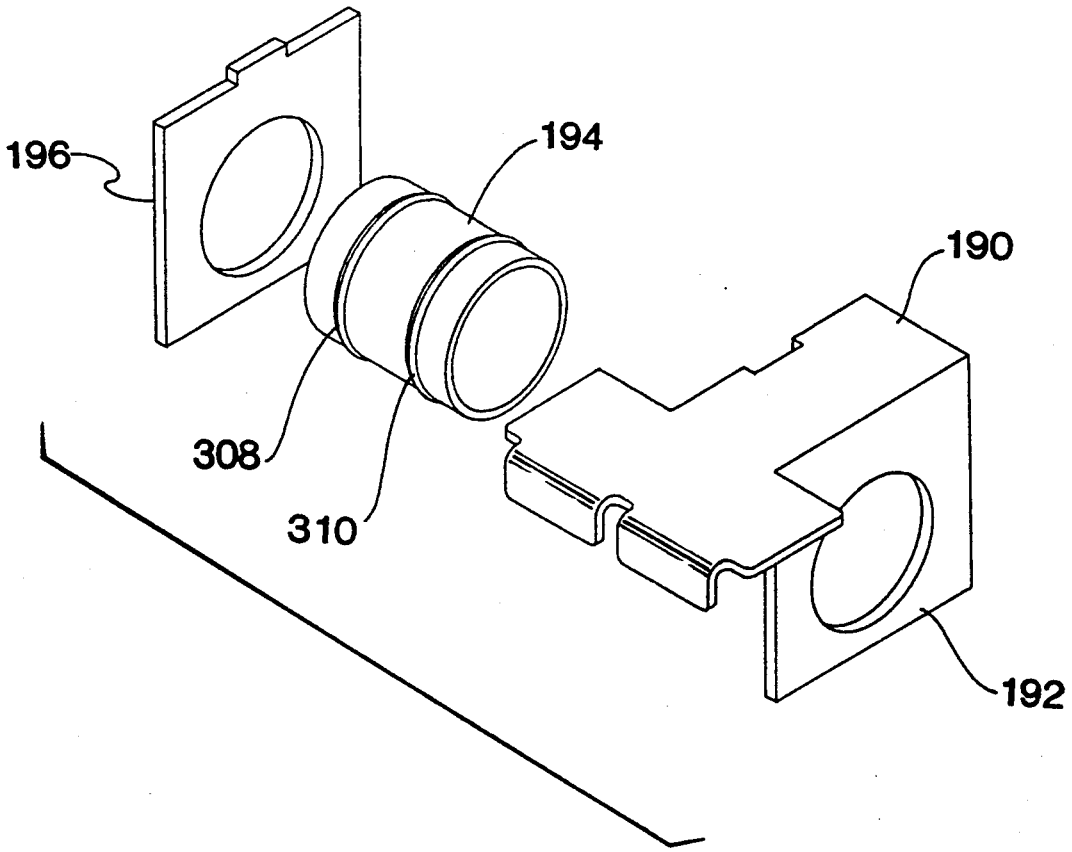
FIG. 12 is an exploded perspective view of the rear portion of the resistance belt system.

FIG. 12 is an exploded perspective view of the rear portion of the resistance belt system including a top plate 190, a side plate 192 secured thereto, a resistance hub 194 and a second side plate 196 for mating with the top plate 190. Radius beads 308 and 310 retain the hub 194 between the plates.

Figure 13:
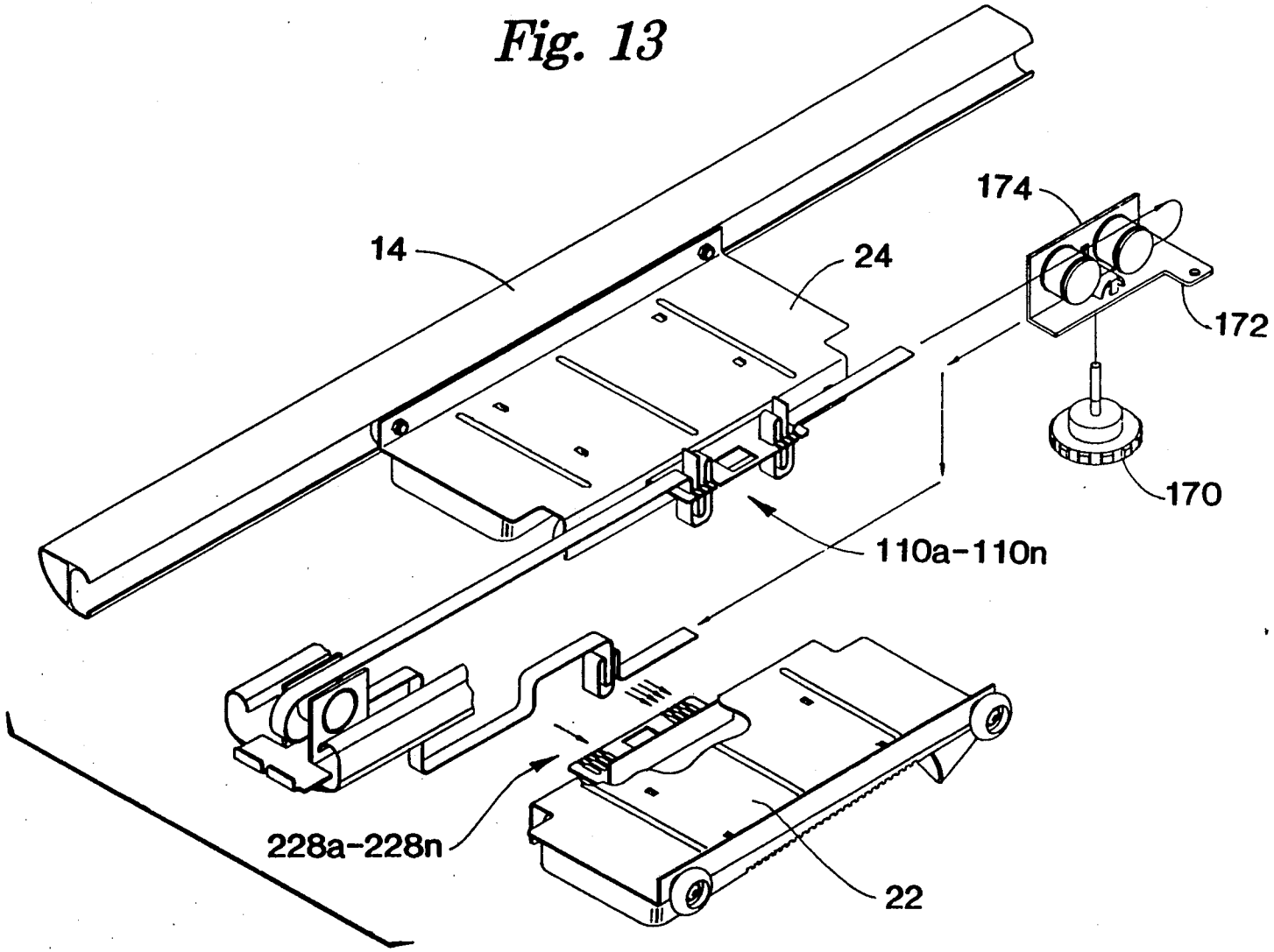
FIG. 13 is an exploded perspective bottom view of the resistance belt system of the present invention depicting the resistance belt connected to the belt anchor associated with the right skate assembly, and including arrows depicting connecting the belt to the left skate assembly.

FIG. 13 is a perspective bottom view of the resistance belt system depicting the resistance belt B about the front and rear hub assemblies 167, 193 and coupled to the belt anchor 104, associated with the right skate assembly 24 and including web slots 110*a*–110*n*, for anchoring the web or belt B to the skate assembly 24. Tension hub 180 applies pressure to the belt B to loosen or tighten it around the hub assemblies 167, 193, thereby decreasing or increasing leg resistance. Particularly illustrated is the wrapping of the belt B through the slots 110*a*–110*n* for easy adjustment as may be required and for easy securing.

FIG. 14 is an enlarged perspective view of the resistance belt system depicted in FIG. 13 and shows, in more detail, that the lower and upper runs of resistance belt B are coupled to the right and left belt anchors 104, 226, respectively, by winding the belt B about the slotted flanges 83, 212 in the slots 110*a*–110*n* and 228*a*–228*n*.

MODE OF OPERATION

In use, a person places the ski exercise machine of the present invention into the position depicted generally in FIG. 1, then stands with one foot on each skate assembly 22, 24 while holding the upper portion of the arm poles 30, 32. To exercise, the user alternately moves each foot forwardly and rearwardly while moving the arm poles in a reciprocal motion, thus simulating the physical motions of cross country skiing. The resistance to movement of the skate assemblies and the arm poles may be varied independently by turning the knob 170 to adjust the resistance belt system and by turning the knob 126 to adjust the arm pole resistance system. One of the advantages of the ski exercise machine of the present invention is that it places the arm resistance torque into a very small compact unit where the opposing torque forces virtually cancel each other out before the torque forces can be transmitted to the base frame/-track assembly. This, as shown, is accomplished by locating the arm resistance torque within the vertical planes of the sides of the center track, as close as possible to the longitudinal axis of that track. It can be seen that the arm resistance mechanism is disposed directly above the center track and that the vertical extension of each of the arm poles originates between said vertical planes of the sides of the center track and also between the two foot skates. It will be seen that the friction pads 138*a*–138*n* and 152*a*–152*n* are arranged in closely spaced vertical planes which extend closely to and along opposite sides of the longitudinal center of the center track 12. It is this arrangement with the vertical arm poles originating immediately adjacent thereto, which causes the opposing torque forces created by movement of the arm poles to cancel each other out, and thereby provide a highly improved arm resistance system. Keeping the torque forces out of the basic frame/track assembly greatly reduces torsional loads thereon and results in a cost effective, durable structure.

To achieve this advantage and the unitized design of the present invention, the arm resistance system or mechanism requires both arm poles 30, 32 to terminate at one location instead of the traditional "left" and "right" attachments. This, in turn, leads to the innovative arm pole configuration rising from a central point at the front of the exercise machine. The arm poles 30, 32 angle to the left and right in such a way as to not interfere with the user's legs and are spaced far enough apart at the upper portion or grips to allow a person of normal build to fit between and grasp the arm poles in use.

Various modifications can be made to the present invention without departing from the apparent scope hereof.

I claim:

1. An exercise machine for providing exercise for a user by simulating cross-country skiing, said machine comprising:

two generally parallel, spaced outer tracks;

a center track having a longitudinal axis, said center track disposed generally between and parallel to said outer tracks;

a pair of reciprocating skate means for receiving said user's feet, said pair of skate means each operably coupled to said center track and a respective outer track;

right and left arm pole means for said user to grasp and move, each of said arm pole means pivotally coupled to said center track, each extending from said center track in respective vertical planes parallel to said longitudinal axis of said center track, each diverging from said center track, and each terminating in respective vertical planes in the vicinity of said outer tracks, whereby said arm pole means do not interfere with said user's body while exercising; and skate resistance means for adjustably varying the resistance of said skate means to movement.

2. The exercise machine according to claim 1, wherein said skate means includes a first foot-receiving skate means for reciprocating movement generally parallel to and between said center track and one of said outer tracks, and a second foot-receiving skate means for reciprocating movement generally parallel to and between said center track and the other of said outer tracks, said first and second foot skate means being operably coupled to said respective tracks.

3. The exercise machine according to claim 1, and arm pole resistance means for adjustably resisting the movement of said right and left arm pole means, said arm pole resistance means operably coupled to said right and left arm pole means and to said center track, said skate resistance means being independent of said arm pole resistance means.

4. The exercise machine according to claim 1, wherein said skate resistance means comprises:

a belt;

front hub means for receiving said belt, said front hub means operably coupled to and substantially covered by said center track;

rear hub means for receiving said belt, said rear hub means operably coupled to and substantially covered by said center track; and adjustment means for adjusting the tension of said belt, said adjustment means operably coupled to said front hub.

5. The exercise machine according to claim 4, wherein said front and rear hubs are mounted substantially completely under said center track, and wherein said belt has opposing runs under said center track and extends around said hubs in taut relation, each one of said opposing runs of said belt being connected to a different one of said skate means, said adjustment means connected to said center track and engaging at least one of said runs of said belt.

6. The exercise machine according to claim 3, wherein said arm pole resistance means comprises torque means connected to said arm pole means for resisting the movement of said arm pole means, said torque means being coupled to said center track adjacent the longitudinal axis of said center track.

* * * * *